US006000682A

United States Patent [19]

Lechtenböhmer

[11] Patent Number: 6,000,682

[45] Date of Patent: Dec. 14, 1999

[54] FENCE POSTS

[76] Inventor: Hans Norbert Lechtenböhmer, Albert-Altwickerstrabe 27, D-47441 Moers, Germany

[21] Appl. No.: 08/945,632

[22] PCT Filed: Apr. 10, 1996

[86] PCT No.: PCT/DE96/00624

§ 371 Date: Oct. 14, 1997

§ 102(e) Date: Oct. 14, 1997

[87] PCT Pub. No.: WO96/33327

PCT Pub. Date: Oct. 24, 1996

[30] Foreign Application Priority Data

Apr. 15, 1995 [DE] Germany ..... 195 14 264

[51] Int. Cl.[6] ..... B21F 27/00

[52] U.S. Cl. ..... 256/32; 256/52; 256/56; 256/35

[58] Field of Search ..... 256/32, 33, 24, 256/47, 48, 52, 49, 54, 55, 56

[56] References Cited

U.S. PATENT DOCUMENTS

| | | | |
|---|---|---|---|
| 780,114 | 1/1905 | Martin | 256/52 X |
| 989,436 | 4/1911 | Smith | 256/35 |
| 3,069,120 | 12/1962 | Elfgren . | |
| 3,423,072 | 1/1969 | Bernstein | 256/32 X |

FOREIGN PATENT DOCUMENTS

| | | | |
|---|---|---|---|
| 472 760 | 3/1992 | European Pat. Off. . | |
| 2 214 643 | 10/1973 | Germany . | |
| 2 220 683 | 11/1973 | Germany . | |
| 2 427 705 | 12/1975 | Germany . | |
| 39 20 108 | 10/1990 | Germany . | |
| 43 39 266 | 5/1995 | Germany . | |
| 1020524 | 2/1966 | United Kingdom | 256/35 |

OTHER PUBLICATIONS

International Search Report dated Jul. 16, 1996.

International Preliminary Examination Report dated Jul. 30, 1997.

English translation of results of the International Preliminary Examination Report.

*Primary Examiner*—Lynne H. Browne
*Assistant Examiner*—John Cottingham
*Attorney, Agent, or Firm*—Vickers, Daniels & Young

[57] ABSTRACT

Fence post (50) of a fence (100) of grid boards (20) comprising narrow, upright grid boards with upright rods (11, 12) and brackets (10) connecting these rods, which brackets project over the front side (13) of the fence post (50) with their free ends (3'). The grid boards (20) lie with horizontal rods (2, 2) on the projecting ends (3'). The projecting ends (3') form retaining elements (3) in the form of hooks that fasten the grid boards (20) at the front side (13) of the fence posts (50).

20 Claims, 4 Drawing Sheets

FENCE POSTS

The invention relates to a fence post for enclosing or limiting purposes of rigid grid boards forming the fence surface, the boards being made of intersecting rods which are connected to one another at the intersection points.

BACKGROUND OF THE INVENTION

A fence post of this type is known from EP 472 760 A1. This fence post comprises a narrow, upright grid board having vertical rods at both edges and connecting, short, straight, horizontal rods connecting the vertical rods in a ladder-like fashion. At least a few of these rods project forward over the vertical grid rods that form the front side of the fence post and are bent around upward in a hook-like manner. The grid boards that form the fence surfaces are laid into these hooks and are retained by screws in the hooks.

A similar fence post is known from DE 39 20 108 C1. The vertical grid rods of the fence post are also connected by means of ladder-like, short, straight, horizontal grid rods from which at least a few project forward over the front side of the fence post where they are bent into eyes that are disposed in horizontal planes in a certain distance from the front side. The grid boards that form the fence surface are laid on the projecting ends of the horizontal grid rods of the fence post and are fixed by means of a vertical, rod-shaped retaining element extended through the eyes. In this specific embodiment, all of the upright grid rods of the fence post can be vertical; yet it is also possible that the fence post becomes wider toward the bottom to increase the stability.

In both known specific embodiments, the vertical grid rods of the fence post can be arranged to be directly opposite one another as double rods at both sides of the horizontal grid rods.

It is difficult to handle the numerous short, horizontal rods for compiling the above known fence posts in machine production of the fence posts by means of resistance spot welding because the hooks or eyes at the horizontal rods are bent prior to welding and the horizontal rods must be welded in a specified rotated position.

Further, the known fence posts are problematic because on their side opposite to the grid board that forms the fence surface many, fairly sharp, freely accessible edges are present by the ends of the horizontal grid rods, which edges can lead to injuries.

SUMMARY OF THE INVENTION

The object of the invention is to improve a fence post of this type with regard to its production and safety from injury.

By means of the embodiment as a bracket, two shanks that are adjacent to one another in elevation form a one-piece part, which on the one hand is larger and only insofar allows simplified handling in contrast to the individual horizontal grid rods of fence posts of the related art, and on the other hand, exhibits a two-dimensional extension such that the projecting ends are always correctly oriented with regard to their design as retaining elements without particular effort and difficulties from accidental rotation of the horizontal rods about their longitudinal axes are eliminated.

On the side opposite the fence surface, hence the web side of the bracket, the bracket is closed and free of ends that form sharp edges such that the risk of injuries is substantially less.

Component of the invention is that the upright rods of the fence post are only provided on one side of the brackets, however, in the preferred specific embodiment, the upright rods are provided on both sides of the brackets in pairs directly opposite one another, to increase the bending strength of the fence post.

The upright rods can diverge downward away from one another in order to increase the base of the fence post and its stability perpendicular to the fence surface.

The preferred specific embodiment, however, provides for upright rods parallel to one another because this accommodates the production of the fence post on an automatic grid welding machine.

For stress on a fence post consisting of grid material, whose connection rods extend essentially horizontally, the forces that arise are predominantly received by means of a shearing stress of the weld points.

To form the stress more favorably and to achieve a type of lattice-work effect, the feature of one shank not extending horizontally is desired.

At least one of the shanks of the bracket should thus extend against the fence surface at an upward or downward angle. A fence post with a lattice-work effect is the object of DE-PS 22 20 683, wherein the upright grid rods, however, do not lie in vertical planes perpendicular to the fence surface, rather they exist in a triangle when viewed in a horizontal projection. Triangular wire brackets are wrapped around outside the vertical grid rods of the fence post in alternating angles of orientation and this configuration is then welded. This type of fence post is not suitable for automatic production.

The bracket according to the invention can be bent to be U-shaped or V-shaped, wherein they can be configured symmetrically particularly to a horizontal plane.

If the grid boards exhibit horizontal rods, they lie with the latter on the projecting ends of the brackets. Mostly, the grid boards in practice are rectangular grids with a vertical separation of 200 mm and a horizontal separation of 50 mm.

Fixing the grid boards on the ends of the brackets can also be achieved, which method is taken from the object of the not previously published DE P 43 39 266 (0–25).

In most cases, the grid rods are round rods because they are the easiest to produce and to handle.

Flat profiles can also be considered as grid rods, which profiles are vertical with their larger dimension on the grid plane, for example, rectangular profiles or ovals or elliptical profiles. Such grid rods increase the bending strength of the grid board and can save the use of double rods in some cases. A practical type of fastening of the grid boards on the posts is also provided. The fastening piece presses the grid board into the diagonal member of a free end and is thus propped against the free end above. It is sufficient if one of this type of fastening piece is provided per post.

The fastening piece is bent in its initial condition and is brought into an extended fastening condition by tightening the screw. Thus, it works like a knee lever and presses the horizontal rods of the grid board with great force from above against the lower free end of a bracket shank.

So that the fastening piece does not slip, a rounded out recess at the upper edge is recommended.

To achieve a safe support on the top side of the horizontal rods, a widened base perpendicular to the grid board is recommended.

In the preferred specific embodiment, the fastening piece comprises a profile section as flat steel that can exhibit a hole in the middle for the penetration of the screw. The hole forms a weakening of the cross-section and thus a set deformation point, which ensures that the fastening piece arches or buckles at the desired point.

Exemplary embodiments of the invention are illustrated in the drawings.

DETAILED DESCRIPTION OF THE INVENTION

Figure 1:
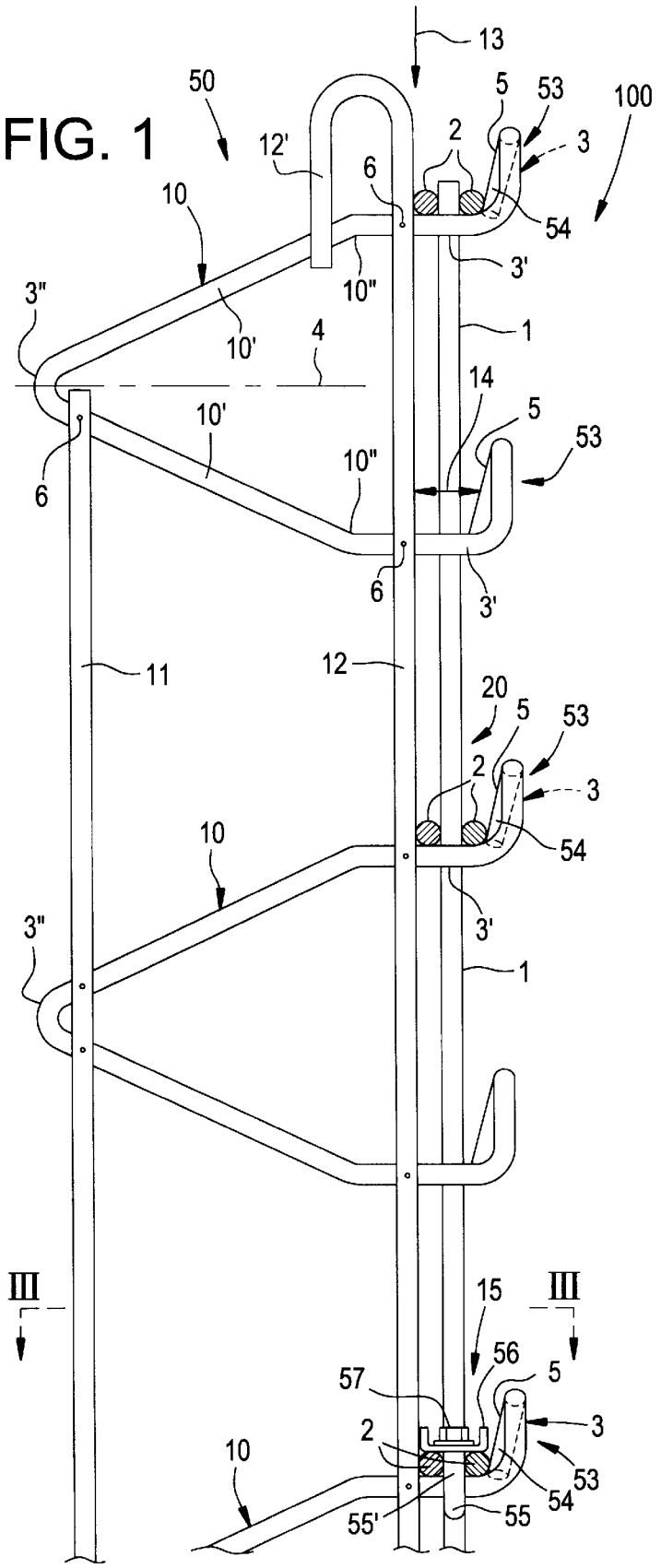
FIG. 1 shows a side view of a fence post, wherein the fence surface is thus perpendicular to the drawing plane.

The fence, which is indicated in its entirety as 100 in FIG. 1, comprises rectangular grid boards 20, which form the fence surface and which are held along the length of the fence by spaced fence posts 50. Grid boards 20 consist of vertical grid rods 1 and pairs of horizontal grid rods 2 which reinforce grid boards 20 and which are configured at equal level of grid rods 1 on both sides of the latter. At the cross points, grid rods 1 and 2 are connected together on a grid welding machine using resistance welding. Grid boards 20 are subjected to the common measures of corrosion protection such as galvanizing and/or power coating after completion of the welding procedure. The separation of grid boards 20 can, for example, be 200 mm high and 50 mm horizontally, wherein the diameter of the grid rods is 6 mm in the exemplary embodiment.

Figure 2:
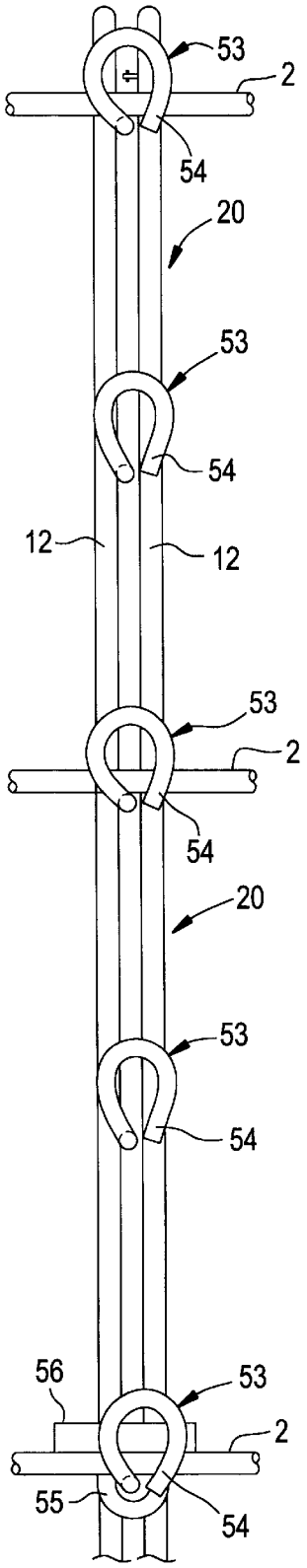
FIG. 2 shows a view in accordance with FIG. 1 from the right.
Figure 3:
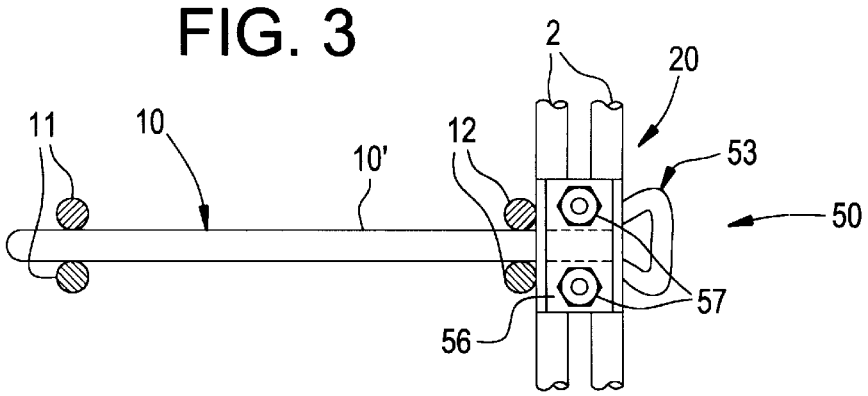
FIG. 3 shows a section along line III—III in FIG. 1.

Fence posts 50 comprise vertical grid rods 11 and 12, from which grid rods 12 the "front side" 13 of respective fence post 50, i.e., the side on which grid boards 20 lie, is formed. At the upper end 12', grid rods 12 are bent back by 180° to prevent the risk of injury. Vertical grid rods 11, 12 are each configured in pairs behind one another parallel to the fence surface, as can be seen in FIGS. 2 and 3, and are connected to one another by means of brackets 10 disposed in between, which brackets lie in a vertical plane perpendicular to the fence surface.

Figure 3A:
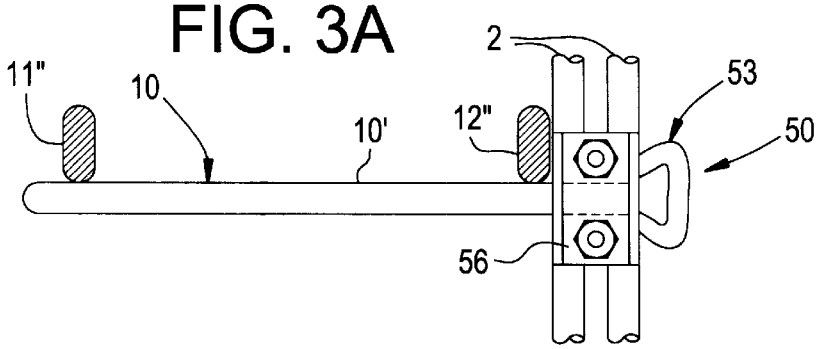
FIG. 3*a* shows a corresponding section through a modified specific embodiment.
Figure 4:
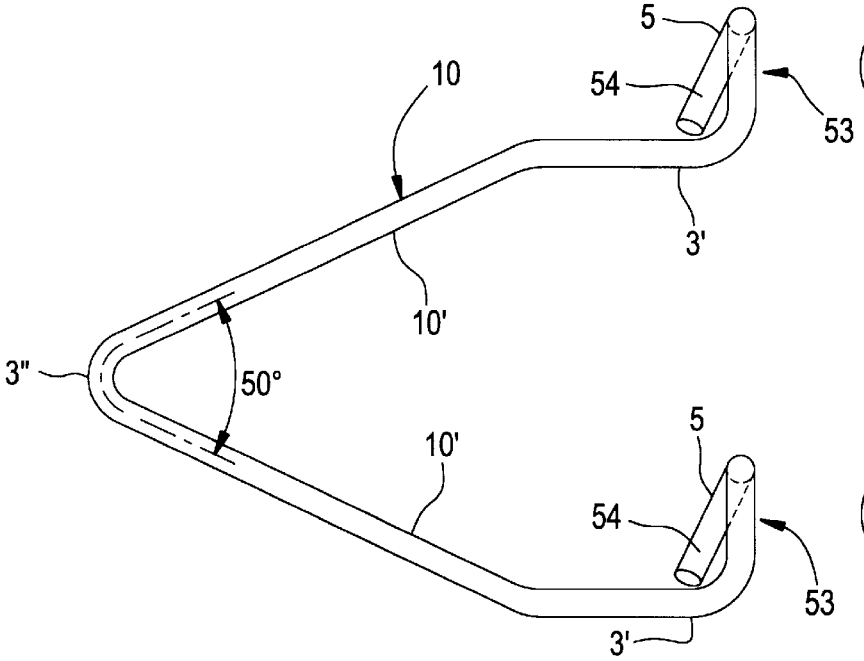
FIG. 4 shows a side view of an individual bracket.
Figure 5:
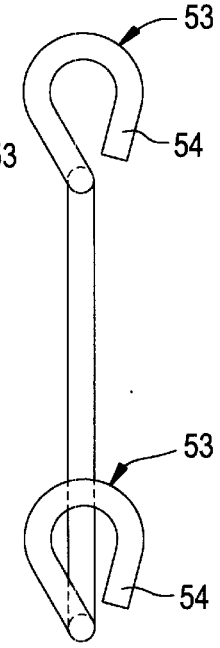
FIGS. 5 and 6 show views in accordance with FIG. 4 from the right and from the top, respectively.
Figure 6:
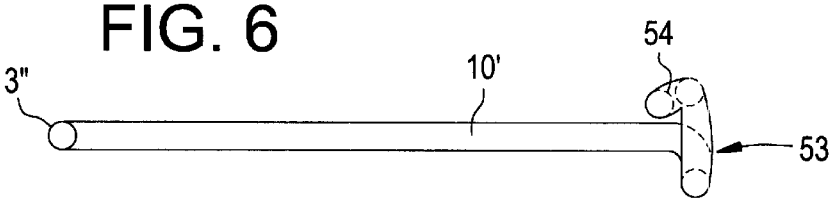

Instead of double rods 11, 11 and 12, 12, rods 11", 12" can also be of a flat profile, which only need to be arranged on one side, as is shown in FIG. 3*a*. The flat profile is on the grid plane with its extension "edge-wise", i.e., on the plane of fence post 50 in this case. In addition to the rectangular profile shown, which is rounded off on both ends, other cross-sections are considered that increase the bending strength without enlarging the width.

Brackets 10, in accordance with FIG. 1, are bent to be V-shaped and exhibit straight shanks 10', which are arranged symmetrically to a horizontal plane 4 going through the bending peak 3". At a point 10" flush against the inside of vertical grid rods 12, shanks 10' are bent against one another and form horizontal ends 3' that extend forward over vertical grid rods 12, which ends are bent upward to a hook 3, in which grid boards 20 are laid with one pair of horizontal grid rods 2 each.

At the cross positions of vertical grid rods 11 and 12, brackets 10 are welded with these vertical grid rods 11 and 12. For welding and the subsequent corrosion protection as well as the diameter of the grid rods, the information already present on grid boards 20 applies. The weld points are indicated by 6 for upper-most bracket 10 in FIG. 1.

Brackets 10 are equal and are configured such that the separation of projecting ends 3' is constant along the height, i.e., that the distance of projecting ends 3' of bracket 10 is exactly as great as the distance from lower projecting end 3' of bracket 10 as to upper projecting end 3' of bracket 10 located below it.

In the exemplary embodiment given, this separation is 100 mm, i.e., half of the vertical separation of grid boards 20. The purpose thereof is to be able to make staged adjustments for slanted ground. In this embodiment, every other projecting end 3' remains free with hook 3 formed thereon.

It can be seen from FIG. 1 that with a minimum of material use, a post is achieved that is designed essentially as a plane component that is thus suitable for the production on automatic grid welding machines, which post exhibits an optimal lattice-work reinforcement in the vertical plane lying perpendicular to the fence plane.

The production of the fence post on the grid welding machine is simplified because two shanks 10' connecting vertical grid rods 11, 12 always form a one-piece part and the hooks positioned at both projecting ends 3' exhibit a correct orientation as specified, i.e., they cannot rotate in the grid welding machine about axes running perpendicular to the fence plane.

In the assembly of the fence, grid boards 20 are hung in hooks 3. The fastening of the grid boards in hooks 3 is as is desired. In the exemplary embodiment illustrated, a particularly simple fastening that continually suppresses vibrations is given, which fastening is essentially based on the formation of the hook. The projecting ends 3' of brackets 10 are bent to upright eyes 53, which extend essentially parallel to the fence surface. The free end 54 of eye 53, however, no longer extends parallel to the fence surface, rather it is slanted downward against front side 13 of post 50, which front side 13 is formed by means of the front side of grid rods 12. Free end 54 extends downward to the level of projecting end 3', to which it is bent. Free end 54 extends essentially straight downward against front side 13 and forms a diagonal member 5.

This is to be measured in its position relative to front side 13 such that distance 14 corresponding to the "thickness" of the grid boards (FIG. 1) is achieved approximately at the half level of eye 53, such that grid boards 20 do not lower down to projecting ends 3' when hung in hooks 3, but rather remain hanging approximately at this half level and can only be drawn or pushed to projecting end 3' under elastic tension of free end 54. In this position, free end 54 creates a tension of grid boards 20 against front side 13 of fence post 50 by means of it wedge-like effect.

The tension is maintained in the exemplary embodiment by means of a suppression retainer 15, which comprises a U-shaped bracket 55 grasping under projecting end 3' having threaded shanks 55', which bracket extends through between horizontal rods 2,2 of grid board 20, which rods lie on projecting end 3'. A U-profile lies on horizontal rods 2,2, which profile is screwed on by means of the nuts 57 screwed onto threaded shank 55'. In this way, horizontal rods 2,2 are held down on projecting ends 3'. Suppression retainers 15 need not be attached to all horizontal rods 2,2.

Figure 7:
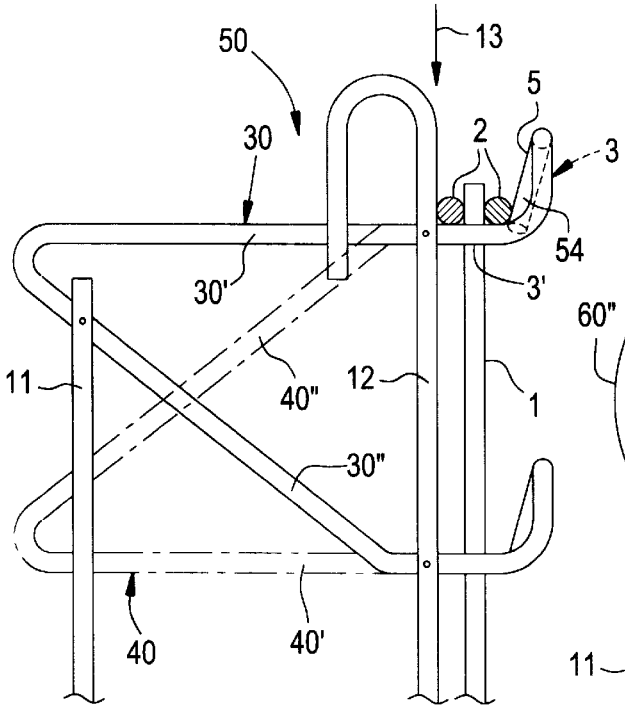
FIGS. 7 and 8 show side views corresponding to FIG. 1 with several variation options of the shape of the brackets.
Figure 8:
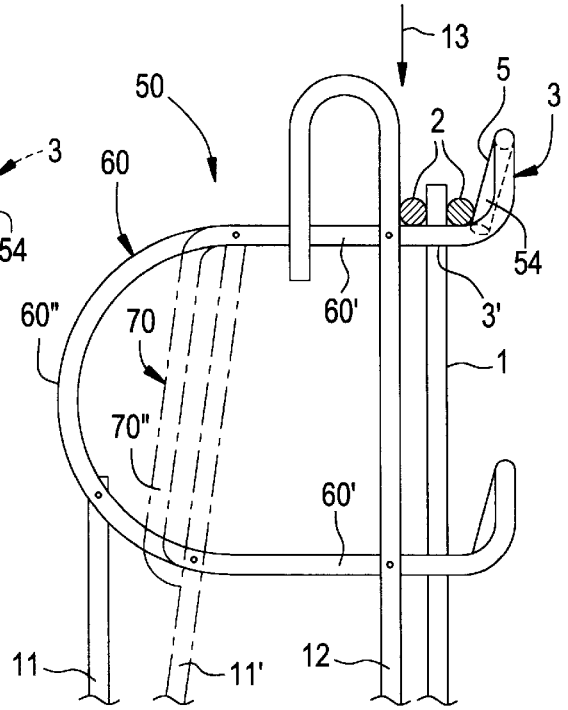
Figure 9:
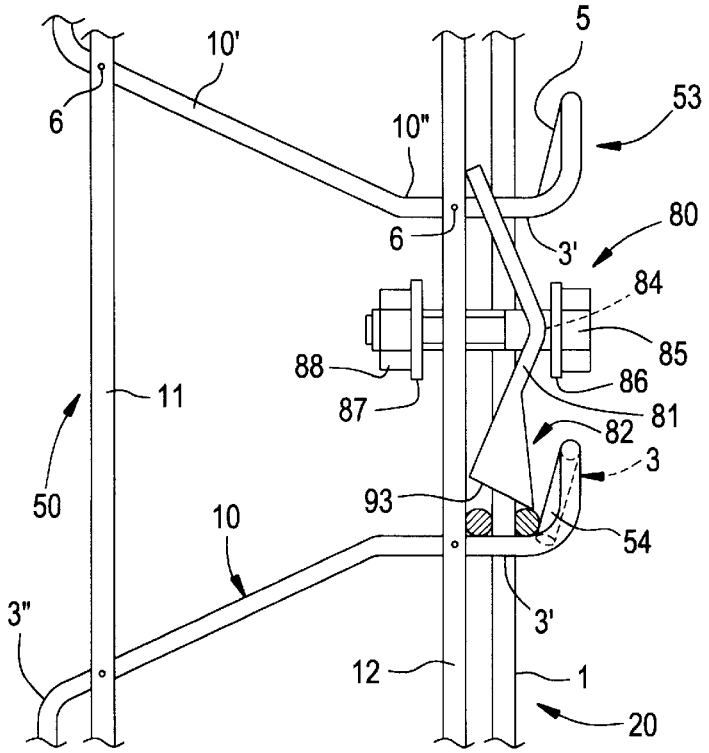
FIG. 9 shows a side view corresponding to FIG. 1 of a post with a fastening piece in its unfastened state.
Figure 10:
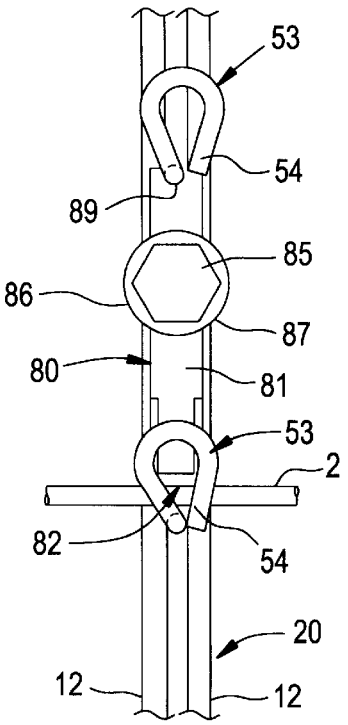
FIG. 10 shows a view in accordance with FIG. 9 from the right.

Variations of the bracket shape are illustrated in FIGS. 7 and 8. The shanks of these brackets are also placed in a plane between the upright grid rods 11, 12 mounted on both sides.

A V-shaped configuration is given for bracket 30, wherein upper shank 30' extends horizontally, lower shank 30" is aligned downward against front side 13 of post 50 at approximately a 40° angle.

The variation of a bracket 40 is shown in FIG. 7 as the dashed line, lower shank 40' is horizontal and upper shank 40" extends upward against front side 13 at an angle of approximately 40°.

In a variation illustrated in FIG. 8 in which bracket 60 is not V-shaped, rather U-shaped, web 60" or the base of the "U" extends almost in a semi-circle and connects the essentially horizontal shank 60' with one another.

For the specific embodiment indicated by a dashed line in FIG. 8, grid rods 12 that form front side 13 of post 50 extend vertically, while rear grid rods 11' are slightly slanted and diverge downward from grid rods 12 such that fence post 50 obtains a wider base. Bracket 70 could be bent in this case, such that it, with its web 70", extends just outside of upright grid rods 11 parallel to the rods.

There are numerous alternatives possible between the sample variations given. Common to all of the specific embodiments is that the retaining elements for horizontal grid rods 2,2 of grid board 20 are formed at the ends of the shanks that project over front side 13 of fence post 50 by brackets bent in a plane, and, in fact, at both shanks.

Figure 11:
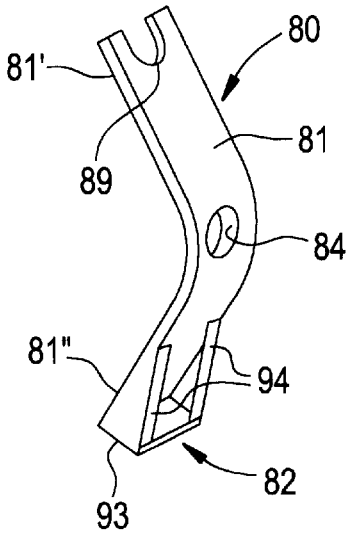
FIG. 11 shows a perspective view of the fastening piece already used in FIGS. 9 and 10.
Figure 12:
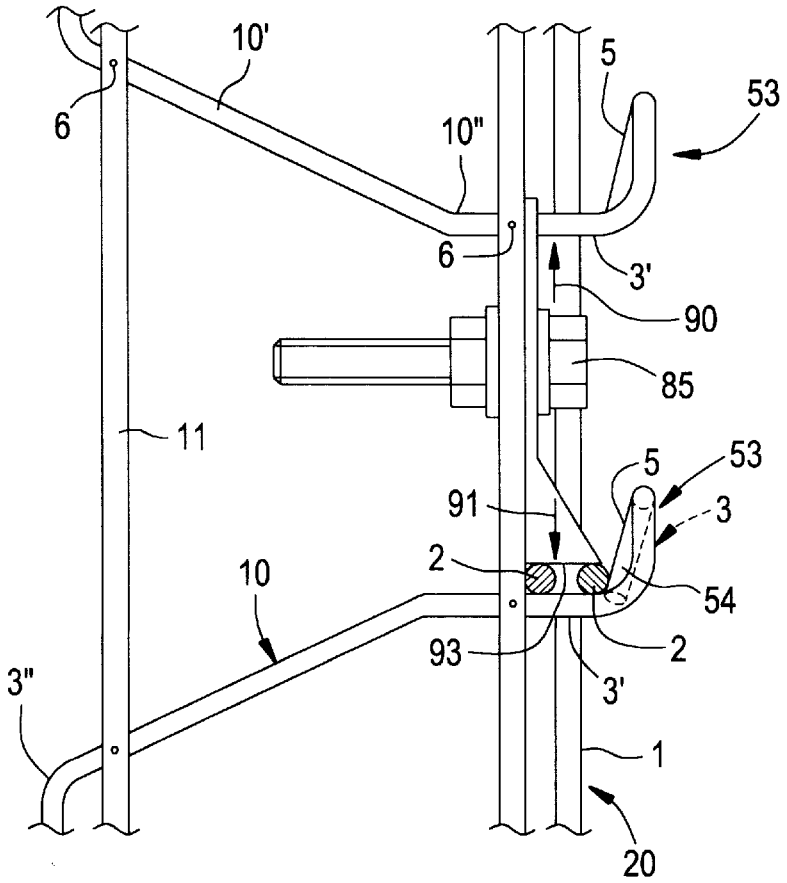
FIG. 12 shows a view corresponding to FIG. 9 in the fastened state.

Instead of using suppression retainer 15, grid board 20 can also be fixed to post 50 by means of a fastening piece 80, which is illustrated in FIGS. 9 through 12. Fastening piece 80 is depicted in unfastened state in FIGS. 9, 10 and 11. Fastening piece 80 comprises a flat steel section 81 having a U-shaped rounded cut-out 89 on its upper edge, the width of which corresponds approximately to the diameter of free end 3'. Approximately in the middle, fastening piece 80 exhibits a throughhole 84 for the passage through of threaded screw 85. On the lower end, a support foot is formed—designated in its entirety by 82—having support surface 93, which extends horizontally in the fastening position perpendicular to the fence surface, as can be seen in FIG. 12. Support surface 93 is supported by means of two triangular support members 94 in the exemplary embodiment. It can also be sufficient, however, if support surface 93 is formed simply by means of a forward bend of flat steel section 81.

Fastening piece 80 is arched or buckled forward in its initial state, wherein the peak is in the area of hole 84 (FIG. 11). For example, sides 81', 81" form a 45° angle with one another. In this arched or buckled state, fastening piece 80 is mounted in the manner seen in FIG. 9. Screw 85 is inserted through and lies on top of a plain washer 86 on the front side of flat steel section 81 in the area of hole 84. The shaft of screw 85 grasps through between the two vertical rods 12 of post 50. A plain washer 87 is provided on the back side of vertical rods 12, which washer lies against the back side of vertical rods 12. When tightening screw 85 by means of nut 88, fastening piece 80 extends, wherein it exercises a force 90 at the upper end in recess 89 from below against upper free end 3' and foot 82 effects an equal force 91 from above on the two horizontal rods 2 of grid board 20, which are thereby pressed down by means of diagonal member 5 on the top side of lower free end 3'.

By means of just one screw 85 and a simply configured fastening piece, grid board 20 is securely fastened on post 50 in this manner.

Having thus described the invention, it is claimed:

1. A post for a fence for enclosing or limiting purposes of a rigid grid forming the fence surface, comprising intersection portions distributed along the height of the post equipped with retaining elements provided on the post, the post including narrow, upright grid rods that are generally vertical and perpendicular to the fence surface, said grid rods in at least a first plane and at least one additional rod in a parallel plane adjacent thereto, said additional rod intersecting the upright rods and being connected with these upright rods at the intersection portions, said additional rod including two projection portions projecting forward over the front side of the fence post and forming said retaining elements at a free end of each said projection portion, each said additional rod being a bracket configured in a vertical plane, said bracket having two legs with each said leg forming one said retaining element at each said free end.

2. The fence post as defined in claim 1, wherein the upright rods are only provided on one side of the brackets.

3. The fence post as defined in claim 1, wherein the upright rods are provided on both sides of the brackets in pairs directly opposite one another.

4. The fence post as defined in claim 1, wherein the upright rods diverge downward from one another.

5. The fence post as defined in claim 1, wherein the upright rods are parallel to one another.

6. The fence post as defined in claim 1, wherein at least one segment of said bracket does not extend horizontally.

7. The fence post as defined in claim 1, wherein the brackets are bent to be U-shaped.

8. The fence post as defined in claim 1, wherein the brackets are bent to be V-shaped.

9. The fence post as defined in claim 8, wherein the brackets extend symmetrically to a horizontal plane.

10. The fence post as defined in claim 1, wherein the grid boards comprise horizontal rods and the horizontal rods are supported on at least a few of the ends of the brackets projecting over the front side of the post.

11. A post for a fence for enclosing or limiting purposes of a rigid grid forming the fence surface, comprising intersection portions distributed along the height of the post equipped with retaining elements provided on the post, the post including narrow, upright grid rods that are generally vertical and perpendicular to the fence surface, said grid rods in at least a first plane and at least one additional rod in a parallel plane adjacent thereto, said additional rod intersecting the upright rods and being connected with these upright rods at the intersection portions, said additional rod including two projecting portions projecting forward over the front side of the fence post and forming said retaining elements at a free end of said projecting portion, each said additional rod being a bracket configured in a vertical plane, said bracket having two legs with each said leg forming one said retaining element at each said free end, said free ends of the brackets projecting over the front side are bent to an upright eye, the free shank of which forms diagonal members directed downward in the bracket plane against the front side of the post, whereby a horizontal rod of said fence surface can be wedged against the front side of the post.

12. The fence post as defined in claim 11, wherein suppression retainers are provided whereby a horizontal rod of said fence surface can be pressed down or drawn down on the projecting portions of the brackets.

13. The fence post as defined in claim 1, wherein the rods exhibit a flat cross-section standing with its larger dimension perpendicular on the grid plane.

14. A post for a fence for enclosing or limiting purposes of a rigid grid forming the fence surface, comprising intersection portions distributed along the height of the post equipped with retaining elements provided on the post, the post including narrow, upright grid rods that are generally vertical and perpendicular to the fence surface, said grid rods in at least a first plane and at least one additional rod in a parallel plane adjacent thereto, said additional rod intersecting the upright rods and being connected with these upright rods at the intersection portions, said additional rod including two projecting portions projecting forward over the front side of the fence post and forming said retaining elements at a free end of each said projecting portion, each said additional rod being a bracket configured in a vertical plane, said bracket having two legs with each said leg forming one said retaining element at each said free end, at least one oblong fastening piece is provided said fastening piece props itself with its upper end against an upper free end of said bracket by means of a vertical press force from below, said fastening piece is tightened in the middle area against the front side of the post by means of a screw, and rests with its lower end by means of a vertical press force from above adjacent a lower free end.

15. The fence post as defined in claim 14, wherein the fastening piece can be formed by means of the screw from a bracket-like initial condition that is arched and buckled from the front side of the fence post, into an extended fastening condition.

16. The fence post in claim 14, wherein the fastening piece exhibits a rounded out recess at its upper edge to grab under the upper free end.

17. The fence post as defined in claim 14, wherein the fastening piece exhibits a widened foot perpendicular to the grid board at its upper end, whereby said foot rests on the upper side of a horizontal rod of said fence surface.

18. The fence post as defined in claim 14, wherein the fastening piece comprises a flat steel section.

19. The fence post as defined in claim 18, wherein the flat steel section exhibits a hole approximately in the middle for insertion of the screw.

20. The fence post as defined in claim 7, wherein the brackets extend symmetrically to a horizontal plane.

* * * * *